United States Patent [19]

Takasaki

[11] Patent Number: 4,650,230

[45] Date of Patent: Mar. 17, 1987

[54] LATCH AND LOCK MECHANISM FOR DOOR HANDLE

[75] Inventor: Kunihiko Takasaki, Chiba, Japan

[73] Assignee: Takigen Seizou Co. Ltd., Tokyo, Japan

[21] Appl. No.: 859,233

[22] Filed: May 5, 1986

Related U.S. Application Data

[63] Continuation of Ser. No. 615,948, May 31, 1985, abandoned.

[30] Foreign Application Priority Data

Oct. 18, 1983 [JP] Japan ..... 58-160991[U]

[51] Int. Cl.[4] ..... E05C 1/12; E05B 13/10; E05B 55/00

[52] U.S. Cl. ..... 292/173; 292/DIG. 71; 70/208; 70/221; 70/150

[58] Field of Search ..... 70/207, 209, 210, 215, 70/216, 224, 208, 218, 221, 451, 150; 292/DIG. 71, 173, 341.18; 109/59

[56] References Cited

U.S. PATENT DOCUMENTS

| | | | |
|---|---|---|---|
| 2,201,963 | 5/1940 | Wartian | 70/208 |
| 2,677,338 | 5/1954 | Sassetti | 109/59 |
| 3,045,465 | 7/1962 | Larson | 292/341.18 |
| 3,201,960 | 8/1965 | Berkowitz | 292/341.18 |
| 3,494,650 | 2/1970 | Slopa | 292/173 |
| 3,576,118 | 4/1969 | Doerrfeld | 292/173 |
| 3,743,336 | 7/1973 | Andrews | 292/173 |
| 3,997,201 | 12/1976 | De Schaaf et al. | 292/173 |
| 4,138,869 | 2/1979 | Pelcin | 292/173 |
| 4,170,119 | 10/1979 | Kalis | 292/173 |
| 4,231,597 | 11/1980 | Pelcin | 292/173 |
| 4,309,884 | 1/1982 | Davis | 292/173 |
| 4,420,954 | 12/1983 | Hieronymi et al. | 292/173 |

*Primary Examiner*—Gary L. Smith
*Assistant Examiner*—Vinh Luong
*Attorney, Agent, or Firm*—Martin Smolowitz

[57] ABSTRACT

A handle device for a door which is formed of an assembly installed in a door panel and has a handle grip connected thereto by a pivot pin. A latch is retractably mounted to the assembly and interlocked with the handle grip. A lock is disposed within the assembly and is provided with a cam secured to a rotor of the lock which checks the receding slide of the latch. The lock cam is formed in the shape of a disc and is closely fitted in a circular recess of the assembly.

3 Claims, 5 Drawing Figures

LATCH AND LOCK MECHANISM FOR DOOR HANDLE

This application is a continuation of application Ser. No. 615,948, filed 5/31/85, abandoned.

BACKGROUND OF THE INVENTION

The present invention relates to a door handle device for a large-sized refrigerator, etc. which is equipped with a lock for checking the receding slide of a latch during the closure of a door.

In general, a latch is locked in such a way that one side surface of a lock cam secured to the front end part of the rotor of a lock is held in engagement with the step surface of the latch.

In a prior-art device, however, the lock cam is exposedly arranged in the cavity of a device proper, and a side surface on the opposite side to the side surface engaging the step surface of the latch is not furnished with any means for supporting the opposite side surface.

Therefore, when it is intended to pull and rotate a handle grip unreasonably when in the locked state, an external force loaded on the lock cam through the step surface acts directly as the bending moment and shearing moment of the rotor and a locking pin.

SUMMARY OF THE INVENTION

It is accordingly an object of the present invention to provide a handle device for doors with which the rotor and locking pin of a lock do not suffer distortion damages due to the unreasonable pulling and rotation of a handle grip in a locked state, so a high durability is ensured.

In one aspect of performance of the present invention, a handle device for a door comprises a device proper which is installed on a door panel, a handle grip which is connected to said device proper by a pivot pin, a latch which is retractably mounted in said device proper and which is interlocked with said handle grip, a lock which is mounted on said device proper, and a lock cam which is secured to a rotor of said lock and which checks receding slide of said latch, said lock cam being formed in the shape of a disc and being closely fitted in a circular recess provided in said device proper.

PREFERRED EMBODIMENT OF THE INVENTION

Figure 1:
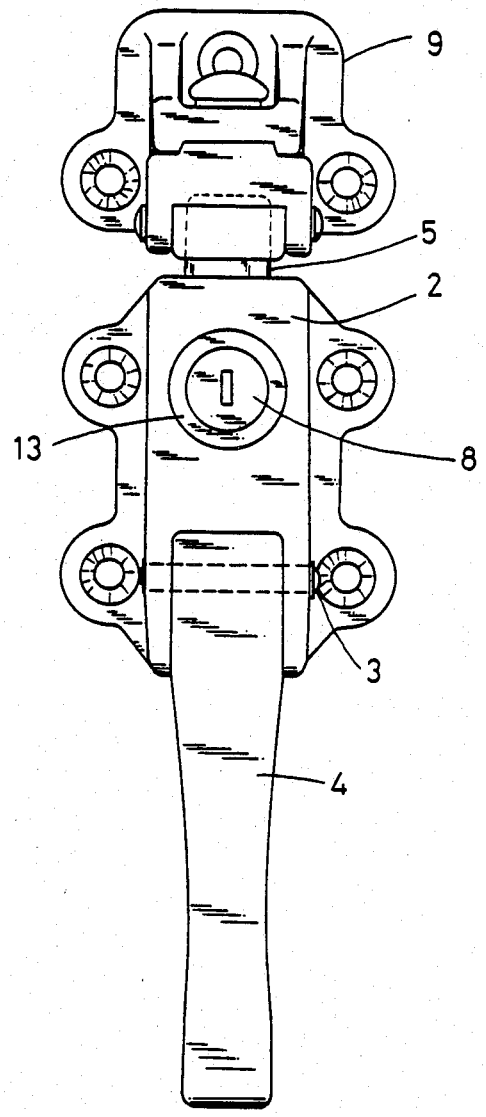
FIG. 1 is a front plan view of a handle device for doors illustrative of an embodiment of the present invention.
Figure 2:
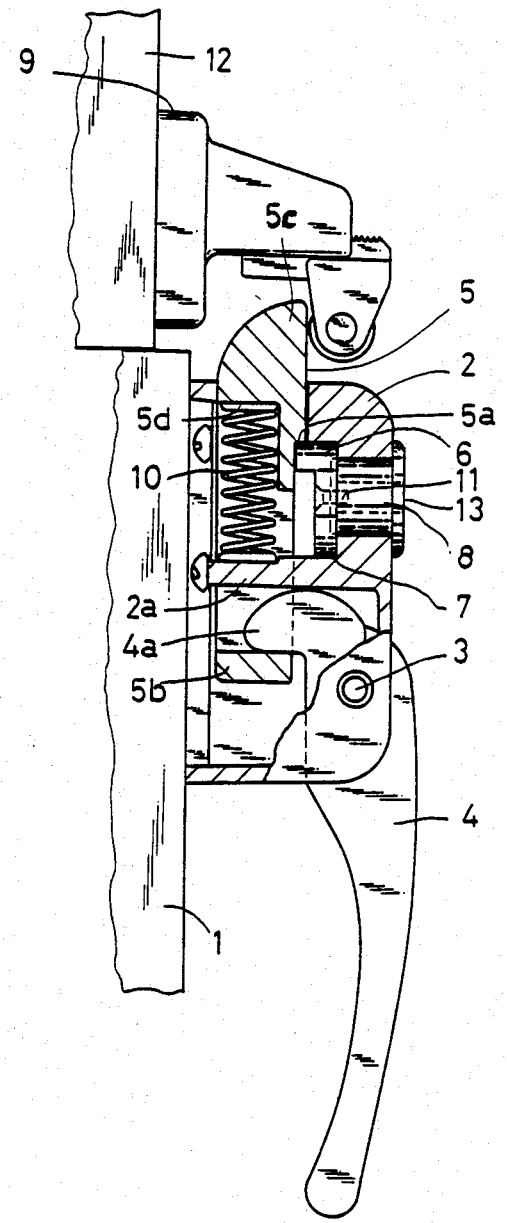
FIG. 2 is a left side elevation view, partly broken away, of the handle device locking the door.
Figure 3:
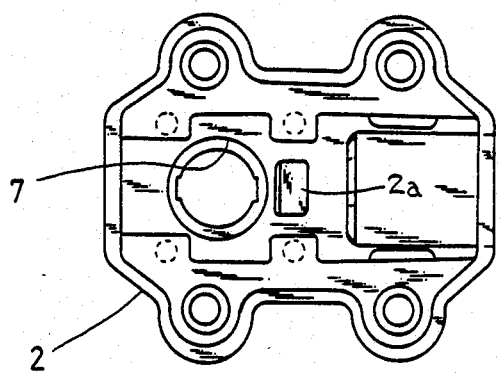
FIG. 3 is a front plan view of a device proper.
Figure 4:
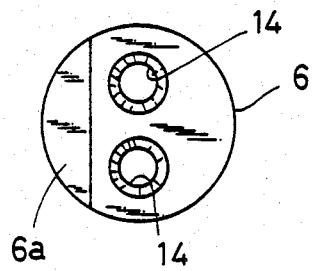
FIG. 4 is a bottom view of a lock cam which is provided in the device shown in FIG. 1.
Figure 5:
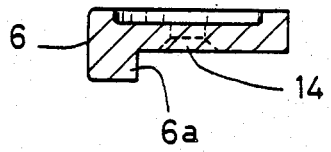
FIG. 5 is a side view of the lock cam.

The present invention will now be described with reference to the drawings illustrating an embodiment thereof. The handle device for doors according to the present invention has a device proper 2 which is installed on a door panel 1. A handle grip 4 is pivotally connected to the device proper 2 by a pivot pin 3. A latch 5 is retractably mounted in the device proper 2 by a compression spring 10, and is interlocked with the handle grip 4. A lock 13 is mounted on the device proper 2. A lock cam 6 is secured to the rotor 8 of the lock 13, and is adapted to check the receding slide of the latch 5 by the handle grip 4. It is to be noted in the door handle device that the lock cam 6 is formed in the shape of a disc and is closely fitted in a circular recess 7 provided in the device proper 2.

In the illustrated embodiment, the front end part **4*a* of the handle grip 4 is held in engagement with the rear end part 5*b* of the latch 5, and the latch 5 is urged to slide in a forward advancing direction by a compression spring 10 which is inserted longitudinally between the inner vertical wall 2*a* of the device proper 2 and the inner wall 5*d* of the latch at the front end thereof. The front end part 5*c* of the latch 5 is held in engagement with a seat 9 secured to the fixed frame 12 of the body of a refrigerator or the like, thereby to latch the door 1 to the fixed frame 12**.

The lock cam 6, which is secured to the front end of the rotor 8 by screws 11 passing through counter sinks 14, has an eccentric projection **6*a* at its lower surface. In the locked state, this eccentric projection 6*a* is arranged on the side of the seat 9 with respect to the center axis of the rotor 8 and is held in engagement with the step surface portion 5*a* of the latch 5, so that the receding slide of the latch 5** is thereby checked.

When a key is inserted into the lock 13 and is turned to rotate the rotor 8 by a half revolution, the eccentric projection **6*a* is arranged on the opposite side from the seat 9 with respect to the center axis of the rotor 8. Therefore, the latch 5 is permitted to slide and recede by a distance double the eccentric distance of the eccentric projection 6*a***.

In the handle device for doors according to the present invention, the lock cam 6 is formed in the shape of a disc and is closely fitted in the circular recess 7 provided in the device proper 2. Therefore, when the handle grip 4 is subjected to substantial pulling and rotation in the locked state, the external force loaded on the lock cam 6 through the step surface **5*a* is supported by the inner peripheral surface of the circular recess 7 which closely abuts on the outer peripheral surface of the disc-shaped lock cam 6. Thus, the rotor 8 and locking pin of the lock 13** do not suffer distortion damages etc., and their durabilities are greatly enhanced.

I claim:

1. A handle device for a door, comprising: a device proper which is installed on a door panel; a handle grip which is pivotally connected to said device proper by a pivot pin;

a latch which is retractably mounted in said device proper and is interlocked with said handle grip; said latch being urged to slide in a forward advancing direction by a compression spring located longitudinally within the latch and device proper;

a lock which is mounted on said device proper; and a lock cam which is secured to a rotor of said lock and which checks directly a sliding movement of said latch, said lock cam being formed in the shape of a disc and being closely fitted in a circular recess provided in said device proper, said lock cam being provided with a downward extending eccentric projection at the cam lower surface which is brought into and out of engagement with a step surface portion of said latch, so as to permit the latch to slide by a distance double the eccentric distance of the eccentric projection and thereby lock and unlock the door, respectively.

2. A handle device for a door according to claim 1, wherein said latch is urged in contact with a seat means by said compression spring, said spring being inserted between an inner vertical wall of the device proper and an inner wall of the latch, so that said latch is retracted by lifting said handle grip.

3. A handle device for a door, said device comprising:

a device proper which is installed on a door panel; a handle grip which is pivotally connected to said device proper by a pivot pin;

a latch which is retractably mounted in said device proper and is interlocked with a front part of said handle grip, said latch being urged to slide forward into contact with a seat means by a compression spring inserted longitudinally between an inner vertical wall of the device proper and an inner wall of the latch, said latch being retracted by lifting said handle grip;

a lock which is mounted on said device proper; and a lock cam which is secured to a rotor of said lock and which checks directly any receding sliding movement of said latch, said lock cam being formed in the shape of a disc and being closely fitted in a circular recess provided in said device proper, said lock cam having an eccentric projection which is brought into and out of engagement with a step surface portion of said latch so as to lock and unlock the door, respectively.

* * * * *